US006213228B1

(12) United States Patent
Saxman

(10) Patent No.: US 6,213,228 B1
(45) Date of Patent: Apr. 10, 2001

(54) ROLLER CONE DRILL BIT WITH IMPROVED PRESSURE COMPENSATION

(75) Inventor: William C. Saxman, Dallas, TX (US)

(73) Assignee: Dresser Industries Inc., Dallas, TX (US)

( * ) Notice: Subject to any disclaimer, the term of this patent is extended or adjusted under 35 U.S.C. 154(b) by 0 days.

(21) Appl. No.: 09/124,173

(22) Filed: Jul. 28, 1998

Related U.S. Application Data

(60) Provisional application No. 60/055,169, filed on Aug. 8, 1997.

(51) Int. Cl.[7] ..... E21B 10/24

(52) U.S. Cl. ..... 175/228; 175/337; 175/371

(58) Field of Search ..... 175/228, 227, 175/337, 371, 372

(56) References Cited

U.S. PATENT DOCUMENTS

| | | | | |
|---|---|---|---|---|
| 2,380,866 | | 7/1945 | Overbeke | 138/30 |
| 2,480,558 | | 8/1949 | De Kiss | 138/30 |
| 3,476,195 | | 11/1969 | Galle | 175/228 |
| 3,578,038 | | 5/1971 | Burford | 141/7 |
| 3,847,182 | | 11/1974 | Greer | 138/30 |
| 3,847,234 | | 11/1974 | Schumacher, Jr. et al. | 175/228 |
| 3,917,028 | | 11/1975 | Garner | 184/6.14 |
| 3,960,179 | | 6/1976 | Zahid | 138/30 |
| 4,017,595 | | 4/1977 | Subramanian et al. | 424/1 |
| 4,051,920 | | 10/1977 | Reinsma | 184/1 R |
| 4,055,225 | | 10/1977 | Millsapps | 175/228 |
| 4,157,122 | * | 6/1979 | Morris | 175/369 |
| 4,161,223 | | 7/1979 | Oelke | 175/228 |
| 4,274,498 | | 6/1981 | Penny | 175/228 |
| 4,276,946 | | 7/1981 | Millsapps, Jr. | 175/228 |
| 4,386,667 | | 6/1983 | Millsapps, Jr. | 175/228 |
| 4,407,375 | * | 10/1983 | Nakamura | 175/228 |
| 4,428,588 | * | 1/1984 | Qelke | 277/83 |
| 4,552,228 | | 11/1985 | Evans et al. | 175/228 |
| 4,593,775 | | 6/1986 | Chaney et al. | 175/228 |
| 4,727,942 | | 3/1988 | Galle et al. | 175/228 |
| 4,792,000 | | 12/1988 | Perkin et al. | 175/228 |
| 5,072,795 | | 12/1991 | Delgado et al. | 175/228 |
| 5,402,858 | | 4/1995 | Quantz et al. | 175/371 |
| 5,558,172 | | 9/1996 | Millsapps, Jr. | 175/228 |
| 5,570,750 | | 11/1996 | Williams | 175/371 |

OTHER PUBLICATIONS

International Search Report dated Nov. 16, 1998 from Patent Cooperation Treaty reInternational Application No. PCT/US98/15993, Nov. 16, 1996.

* cited by examiner

*Primary Examiner*—David Bagnell
*Assistant Examiner*—Zakiya Walker
(74) *Attorney, Agent, or Firm*—Groover & Associates; Betty Formby; Robert Groover

(57) ABSTRACT

A pressure compensating assembly for use in roller cone drilling bits of the sealed bearing type. The compensating assembly includes a hollow body arranged to fit into a cavity in the bit connected with the lubrication system of the bit and the hollow body includes a normally open lubricant passageway extending therethrough. A seal encircles the body on one side of the lubricant passageway and is arranged to sealingly engage the bit and an elastomeric, cup-shaped diaphragm is located on the body and has a lip arranged to sealingly engage the bit on the other side of the lubricant passageway. The diaphragm having a protuberance on the side of the diaphragm facing the passageway and sized to enter and close the passageway. The body, seal, and diaphragm being assembled into a unitary cartridge for introduction into the bit as a unit.

15 Claims, 2 Drawing Sheets

ROLLER CONE DRILL BIT WITH IMPROVED PRESSURE COMPENSATION

CROSS-REFERENCE TO RELATED APPLICATIONS

This application claims benefit under 35 U.S.C. § 119(e) of provisional application number 60/055,169, filed Aug. 8, 1997.

TECHNICAL FIELD OF THE INVENTION

This invention relates to roller cone drill bits. More particularly, the invention relates to roller cone bits having an improved pressure compensating device therein.

BACKGROUND OF THE INVENTION

Sealed bearing roller cone drill bits generally incorporate a compensating mechanism to limit the pressure differential between the lubricant sealed within the drill bit and the well bore fluid. The most common device is a flexible diaphragm separating the two fluids. The diaphragm responds to the conditions in the well to maintain a balanced pressure across the primary dynamic seals in the drill bit.

As previously mentioned, these devices also typically compensate for volumetric changes of the lubricant which occur in the form of leakage or through thermal expansion.

Previously constructed compensators have been generally successful in performing the desired functions. Bit manufacturers currently supply acceptable compensators. However, difficulty is encountered during assembly due to the relatively large number of separate components that must be carefully inserted in the correct sequence into each cavity in each arm of each drill bit. Most of the compensators utilize some form of rolling diaphragm that isolates the drilling mud from the bit lubricant. The rolling action of the diaphragm compensates for volumetric changes in the lubricant.

U.S. Pat. No. 4,276,946 issued Jun. 7, 1986 illustrates one previously constructed compensator that also utilizes the resiliency of the diaphragm to assist in determining when the proper quantity of lubricant has been injected into the system.

SUMMARY OF THE INVENTION

The purpose of the invention is to provide an improved pressure compensating assembly for use in sealed bearing roller cone drill bits to balance the pressure in the bit lubrication system and the drilling mud in the well adjacent to the drill bit. Also, the compensators serve to act as a reservoir to provide a limited amount of additional lubricant to the bit bearings if some lubricant is lost to the exterior of the system.

The inventive pressure compensator device is in the form of a cartridge assembly that is inserted as a unit into drill bits. This negates the necessity for assembling the compensator as it is placed into a cavity formed into the drill bit. Most often, a drill bit includes three cutter supporting arms and each arm is provided with a pressure compensating device. Thus, assembly time and cost saved by the inventive cartridge type compensator is multiplied by three for each drill bit.

In addition, the ability to preassemble the compensators provides better uniformity and substantially reduces problems in filling the lubricant reservoir to the correct volume.

The invention herein provides for a superior pressure compensating means as compared to the prior art. The cartridge type construction of the invention is easily installed and filled with the desired volume of lubricant, yet, the inventive compensator is effective in accommodating the volumetric changes in the lubricant as well as balancing the pressures in the lubricant with that of the well drilling fluid. In addition, the invention contemplates a novel means for retaining the compensator assembly in position in the drill bit.

BRIEF DESCRIPTION OF THE DRAWINGS

A more complete understanding of the invention and its advantages will be apparent from the detailed description taken in conjunction with the accompanying drawings in which.

DETAILED DESCRIPTION OF THE INVENTION

Figure 1:
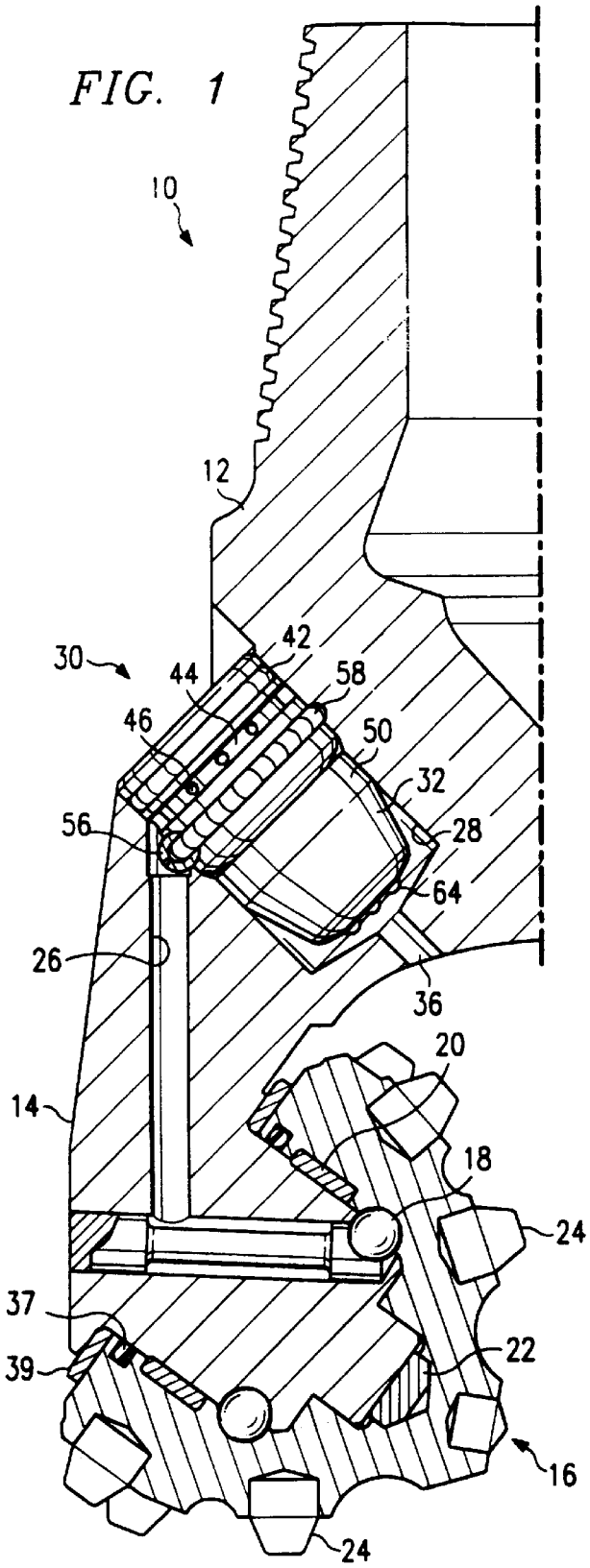
FIG. 1 is a partial, cross-sectional view taken through one arm of a rolling cone drill bit having pressure compensating apparatus that is constructed in accordance with the invention mounted therein.

The preferred embodiment of the present invention and its advantages are best understood by referring to FIGS. 1 through 4 of the drawing wherein like reference characters are used for like parts in all views.

A drill bit 10, only partially shown in FIG. 1, includes a threaded body portion 12, a cone support arm 14, and a cutting cone 16 that is rotatably supported by the arm 14. (Most drill bits have two or more arms 14 and cutting cones 16 mounted on the body 12.)

The cone 16 is illustrated in FIG. 1 as being rotatably supported on the arm 14 by ball bearings 18, a bushing 20, and a thrust button 22. The cone 16 is provided on its outer periphery with a plurality of cutting elements generally indicated by the reference character 24. The cutting elements 24 engage the wall and bottom of a formation. The application of the rotation of and the application of weight to the bit 10 forms a well bore as is well known in the well drilling art.

Lubricant is located within the cone 16 to lubricate the bearings 18, bushing 20, and thrust button 22 and thus, to extend the useful life of the bit. Within the arm 14, there is provided a lubricant passageway 26 and a cavity 28. The cavity 28 is configured to receive a pressure compensating cartridge or assembly 30 that includes a flexible, cup-shaped diaphragm 32 exposed on one side to fluid pressure in the well bore (not shown) through a mud port 36 formed in the arm 14 and on the other side to lubricant pressure.

Figure 2:
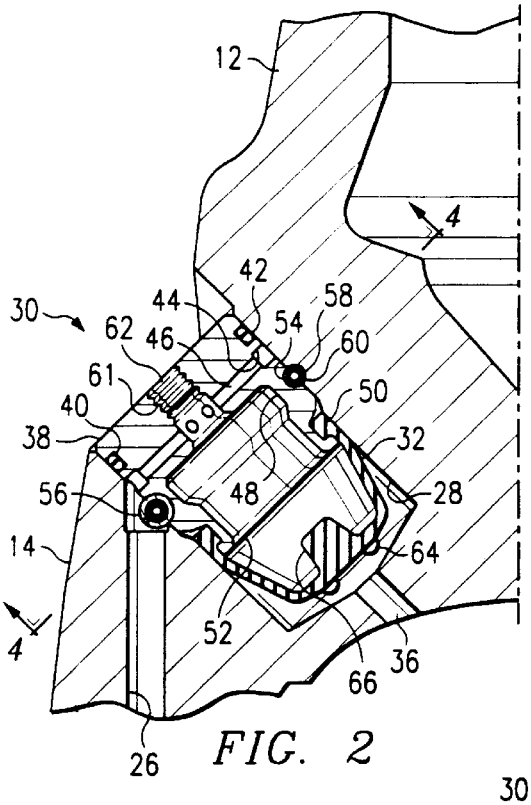
FIG. 2 is an enlarged, partial cross-sectional view of a portion of FIG. 1 illustrating the pressure compensating apparatus in more detail.
Figure 3:
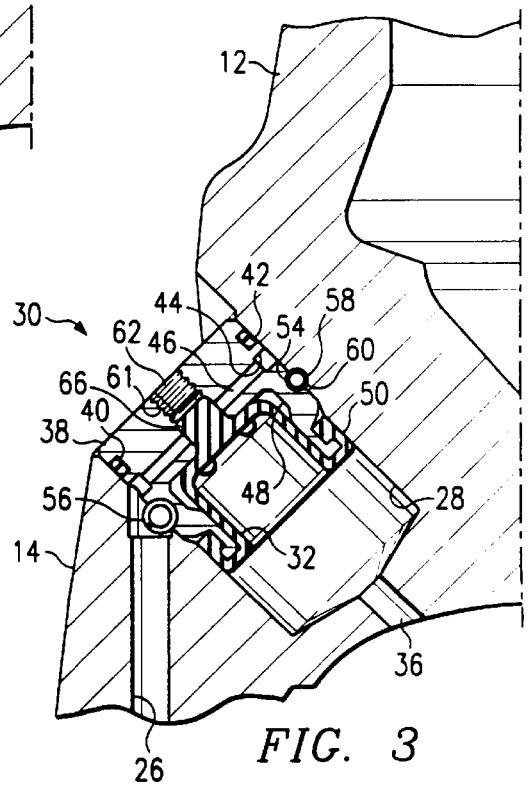
FIG. 3 is a view similar to FIG. 2, but showing the pressure compensating apparatus in another operating position.

As shown in FIGS. 2 and 3, the pressure compensating assembly 30 also includes a body 38 having a first annular recess 40 on the exterior thereof for receiving an o-ring seal 42. A second annular recess 44 on the body has several radial parts 46 to provide fluid communication between lubricant located in a hollow interior 48 of the body 38 and the lubricant passageway 26. The interior 48 is exposed to the interior of the diaphragm 32, which is also initially filled with lubricant.

The diaphragm 32 has an annular lip or rim 50 that is disposed in an annular groove 52 that is formed in the exterior of the body 38. An annular retaining groove 54 (see also FIG. 4) is also formed in the exterior of the body 38. A portion 53 of the groove 54 has been enlarged to receive a short generally cylindrical or tubular keeper 56 which functions to prevent rotation of the assembly 30 when installed in the drill bit 10.

Figure 4:
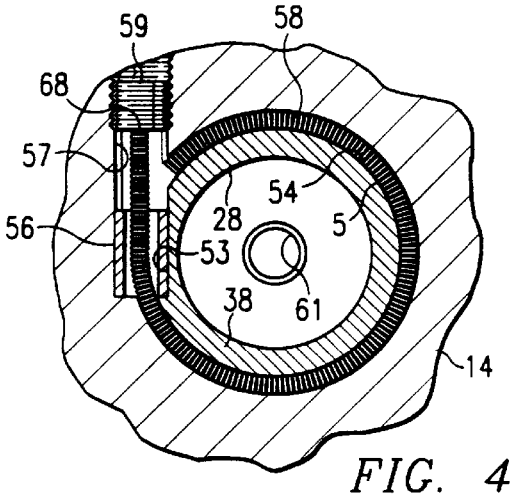
FIG. 4 is a cross-sectional view taken generally along the line 4—4 of FIG. 2 illustrating the novel apparatus for retaining the compensating assembly in the drill bit.

A locking spring 58, or any other type of flexible locking mechanism, is inserted through the keeper 56 into the groove 54 and a mating groove 60 in the wall of the cavity 28 to prevent axial movement of the assembly 30 relative to the arm 14. The keeper 56 and spring 58 are inserted into the arm 14 through a hole 57 bored tangentially to the groove 54 into the arm 14 as shown in FIG. 4. After the spring 58 has been inserted, the hole 57 is plugged with a threaded plug 59 that touches the end of the spring 58 at a point 68. The spring 58 and the keeper 56 can be easily removed when the compensator 30 is to be replaced.

The body 38 also has a fill passageway 61 extending axially through the body 38 intersecting the interior 48 thereof and intersecting the radial ports 46. A removable threaded plug 62 is located in the fill passageway 61.

The diaphragm 32 is preferably provided on its lower exterior with a plurality of bumps or standoffs 64 that prevent the entrapment of drilling mud between the diaphragm 32 and the interior of the cavity 28. On the interior of the diaphragm 32, there is located a protuberance 66 that is shaped and sized to fit into the fill passageway 61 for reasons that will be described.

Bit seals 37 and 39 encircle the arm 14 within the cone 12 to retain the lubricant in the cone 16 and around the bushing 20, bearings 18, and thrust button 22. The seals also prevent deleterious materials from entering into the cone 16 and causing premature bit failure due to bearing failure.

Assembling the inventive pressure compensator 30 prior to insertion into the cavity 28 is a simple matter of placing the seal 42 into the groove 40 and pulling the diaphragm 32 over the body 38 until the lip 50 is located in the groove 52.

The assembled compensator 30 is then inserted into the cavity 28 with the seal 42 and lip 50 sealingly engaging the wall of the cavity 28. The anti-rotation keeper 56 is placed in position in the groove 54 and the locking spring 58 is fed through the hole 57 and the keeper 56 into the mating grooves 54 and 60 positively preventing the assembled compensator from rotating or moving axially in the cavity 28. The locking spring 58 does not completely encircle the wall of the cavity 28, so that the locking spring 58 can be easily removed when necessary. Threaded plug 59 is inserted into the hole 57 after the spring 58 securely locking the compensator in the bit 10.

In order to introduce lubricant into the bit 10, plug 62 is removed from a fill passageway 61 and an appropriate fitting (not shown) is threaded into the passageway 61. Lubricant is then introduced into the passageway 61, filling the interior of the body 38 and of the diaphragm 32. The lubricant expands the diaphragm 32 into engagement with the sidewall of the cavity 28. Further filling causes the lubricant to enter the radial ports 46, pass through the lubricant passageway 26, and into the area around the bearings 18, bushing 20, and thrust button 22. It should be noted at this point that mud cannot be trapped in the cavity 28 because of the standoffs 64 which engage the lower wall of the cavity to maintain a flow space between the diaphragm 32 and the wall of the cavity 28.

When thusly filled, removal of the lubricant fitting (not shown) from the passageway 61 releases the pressure on the lubricant and permits the resiliency of the diaphragm 32 to return it to its original shape forcing some lubricant outwardly of the bit 10 through the passageway 61. This action, assures that the lubrication system of the bit will not be overfilled.

It is important to note that some means must be provided for preventing rotation of the assembly 30 to enable a lubrication device to be attached to the body 38 to pump lubricant into the bit 10. In this invention, that means is provided by the formation of the oversize portion 57 in the groove 54 and inserting the keeper 56 therein. It will be appreciated that the body 38 cannot rotate when the keeper 56 is in place. Using the tubular keeper 56 also permits the locking spring 58 to be easily inserted and removed from the groove 54.

During the operation of the bit 10 during the drilling of a well, drilling mud acts upon the diaphragm 32 through the port 36 and, as lubricant is consumed in the bit or as the pressure in the mud exceeds that of the lubricant, the mud pressure tends to collapse the diaphragm 32, forcing lubricant within the diaphragm 32 to move into the passageway 26.

Should the lubricant in the diaphragm 32 be depleted, the diaphragm 32 assumes a position as illustrated in FIG. 3. In this position, the protuberance 66 is forced into the passageway 61 until the ports 46 are blocked. Thus, the drilling mud is positively prevented from entering the lubrication system of the bit 10 even if the diaphragm 32 should be ruptured.

From the foregoing, it will be appreciated that a compensator 30 manufactured in accordance with this invention, is easily preassembled and inserted as an assembly or cartridge into a drill bit 10. The compensator alleviates pressure differentials between the lubricant and the drilling mud. A bit in which the compensator of this invention is located can be accurately and easily filled to the desired lubricant capacity. Further, the provision of the protuberance 66 on the interior of the diaphragm 32 prevents mud from entering the lubricant passageway 26 even in the event of a diaphragm rupture.

Although the present invention and its advantages have been described in detail, it should be understood that various changes, substitutions, and alterations can be made therein without departing from the spirit and scope of the invention as defined by the appended claims.

What is claimed is:

1. A roller cone drill bit comprising:

a plurality of arms having respective cones rotatably mounted on said arms;

bearings located between ones of said plurality of arms and said respective cones;

respective sealed lubrication systems providing lubrication to said bearings, said lubrications systems having a pressure compensator device, the compensator device consisting of:

a hollow body member releasably connected to the drill bit body and sized to fit within the bit lubrication system with a lubricant passageway extending therethrough;

an annular seal member encircling the hollow body and located on one side of the lubricant passageway and arranged to sealingly engage the drill bit; and an elastomeric diaphragm member mounted on the hollow body member and having a lip encircling the hollow body and arranged to sealingly engage the bit on the other side of the lubricant passageway;

wherein the hollow body, seal, and diaphragm member are assembled into a unitary cartridge for introduction into a cavity in the drill bit as a single unit.

2. The drill bit of claim 1 wherein the diaphragm member has an internal protuberance having a diameter sized to enter a fill passageway and close the lubricant passageway.

3. The drill bit of claim 1 wherein the diaphragm member has a plurality of external standoff protrusions which prevent the entrapment of drilling mud between the diaphragm and the drill bit body.

4. The drill bit of claim 1 wherein the diaphragm member is cup-shaped.

5. A pressure compensator device for use in a sealed lubrication system of a roller cone drill bit, the compensator device comprising:

a hollow body member releasably connected to the drill bit body and sized to fit within the bit lubrication system with a lubricant passageway extending therethrough;

an annular seal member encircling the hollow body and located on one side of the lubricant passageway and arranged to sealingly engage the drill bit;

an elastomeric diaphragm member mounted on the hollow body member and having a lip encircling the hollow body and arranged to sealingly engage the bit on the other side of the lubricant passageway;

an annular locking groove encircling the cavity in the drill bit;

a mating annular locking groove on the pressure compensator device adjacent to the locking groove encircling the cavity;

an elongated locking member disposed in the mating annular locking groove to retain the pressure compensator device in the drill bit wherein the elongated locking member is a spring; and a threaded plug to secure the elongated locking member into place.

6. The pressure compensator device of claim 5 further comprising:

an enlarged portion in the annular locking groove, and a tubular keeper member sized to fit into the enlarged portion and having an interior sized to permit the elongated locking member to pass through.

7. The pressure compensator device of claim 5 further comprising:

a plug at one end of the lubricant passageway that is removed to thread a fitting into the lubricant passageway to introduce lubricant into the lubricant passageway.

8. A roller cone drill bit, the drill bit having a pressure compensator device for use in a lubrication system of the drill bit, said drill bit having a cavity, wherein the pressure compensator device comprises:

a hollow body having a fill passageway, said fill passageway communicating with one or more lubricant passageways;

an annular seal member encircling the body and located on one side of the lubricant passageways, and arranged to sealingly engage the drill bit;

a diaphragm mounted on the body arranged to sealingly engage the drill bit on the other side of the fluid passageway;

an annular locking groove encircling the cavity in the drill bit;

a mating annular locking groove on the pressure compensator device adjacent to the locking groove encircling the cavity;

an elongated linear locking member disposed in the mating annular locking groove to retain the pressure compensator device in the drill bit;

an enlarged portion in the annular locking groove; and a tubular keeper member sized to fit into the enlarged portion and having an interior sized to permit the elongated locking member to pass through.

9. The bit of claim 8, wherein the elongated linear locking member is a spring.

10. The bit of claim 8, further comprising a threaded plug to secure the elongated linear locking member in place.

11. A roller cone drill bit comprising:

an arm having a cone rotatably mounted on said arm;

bearings located between said arm and said cone;

a sealed lubrication system in communication with said bearings, said lubrications system having a pressure compensating device, said pressure compensating device comprising:

a hollow body having a fill passageway, said fill passageway having an opening for communication with a lubricant passageway;

an annular seal member encircling the body and located on one side of said opening and capable of sealingly engaging the drill bit;

a diaphragm mounted on the body, said diaphragm being capable of sealingly engaging the drill bit on the other side of the opening;

wherein said diaphragm contains a protuberance which, in one position, will enter said fill passageway until said opening is blocked.

12. The drill bit of claim 11, wherein said diaphragm is substantially cup-shaped.

13. The drill bit of claim 11, wherein said protuberance blocks said opening when said lubricant is depleted.

14. A pressure compensating device for use in a sealed lubrication system of a drill bit, said pressure compensating device comprising:

a hollow body having a fill passageway, said fill passageway having an opening for communication with a lubricant passageway;

an annular seal member encircling the body and located on one side of said opening and capable of sealingly engaging the drill bit;

a diaphragm mounted on the body, said diaphragm being capable of sealingly engaging the drill bit on the other side of the opening;

wherein said diaphragm contains a protuberance which, in one position, will enter said fill passageway until said opening is blocked.

15. The drill bit of claim 14, wherein said protuberance blocks said opening when said lubricant is depleted.

* * * * *